US008037627B2

(12) United States Patent
Pan et al.

(10) Patent No.: US 8,037,627 B2
(45) Date of Patent: Oct. 18, 2011

(54) IRON

(75) Inventors: Chienchih Pan, Tai nan (TW); Yan Jiang, Fujian (CN)

(73) Assignee: Tsann Kuen (China) Enterprise Co., Ltd., Xiamen, Fujian (CN)

( * ) Notice: Subject to any disclaimer, the term of this patent is extended or adjusted under 35 U.S.C. 154(b) by 0 days.

(21) Appl. No.: 12/249,024

(22) Filed: Oct. 10, 2008

(65) Prior Publication Data

US 2011/0035973 A1 Feb. 17, 2011

(30) Foreign Application Priority Data

Oct. 10, 2007 (CN) ..... 2007 2 0008464 U

(51) Int. Cl.
*D06F 75/20* (2006.01)
*D06F 75/38* (2006.01)

(52) U.S. Cl. ..... 38/77.83; 38/93

(58) Field of Classification Search ..... 38/74, 77.1, 38/77.5–77.9, 88, 93; 219/245, 255
See application file for complete search history.

(56) References Cited

U.S. PATENT DOCUMENTS 4,077,143 A * 3/1978 Walker et al. ..... 38/77.83
5,444,216 A * 8/1995 Bouleau et al. ..... 219/245
5,704,143 A * 1/1998 Kubicz ..... 38/77.83
6,802,141 B2 * 10/2004 Walther ..... 38/77.83
6,953,912 B2 * 10/2005 Alday Lesaga ..... 219/251

* cited by examiner

*Primary Examiner* — Ismael Izaguirre
(74) *Attorney, Agent, or Firm* — Kening Li; Pinsent Masons LLP

(57) ABSTRACT

An iron comprising a water tank, a blast unit, a steam generating unit and a steam spraying unit. The blast unit has a first inlet and a first outlet, the first inlet is connected to the inlet-pipe of the inlet of the water tank, wherein the blast unit generates steam rapidly in a limited space. The steam generating unit has a second inlet and a second outlet, the second inlet being connected to the inlet-pipe of the inlet of the water tank, wherein the steam generating unit heats the water to generate steam. The steam spraying unit connects the first and second outlet, has plural steam apertures, and sprays steam. Because a blast unit is arranged for the rapid steam generation in a limited space, the iron of the present invention obviates the disadvantages in the existing irons and improves steam blast strength, intensity at a low cost.

7 Claims, 1 Drawing Sheet

IRON

FIELD OF THE INVENTION

The present invention relates to an iron.

BACKGROUND OF THE INVENTION

Irons existing currently in the market usually comprise a water tank, a steam generating unit and a steam spraying unit. The steam generating unit has an inlet and an outlet, wherein the inlet connected to the inlet-pipe of the water tank, the outlet connected to the steam spraying unit, wherein the steam generating unit used for heating the water to generate steam. The steam spraying unit has plural apertures, and the steam spraying unit is used for spraying steam to iron. Because the steam generating unit has large space, the blast force from the outlet is often inadequate, and a big heating plate must be used to generate enough blast force, increasing cost.

SUMMARY OF THE INVENTION

The object of the present invention is to provide an iron which obviates the disadvantages of conventional irons that the steam generating unit has large space thus the blast force from the outlet is not enough.

The above and other objects of the invention are achieved by providing an iron comprising a water tank, a blast unit, a steam generating unit and a steam spraying unit. The blast unit has a first inlet and a first outlet, the first inlet connected to the inlet-pipe of the inlet of the water tank, herein the blast unit used for rapid steam generating in a limiting space to blast. The steam generating unit has a second inlet and a second outlet, the second inlet connecting to the inlet-pipe of the inlet of the water tank, herein the steam generating unit used for heating water and generating steam. The steam spraying unit connecting to the first and second outlet, it has plural steam apertures, herein the steam spraying unit used for spraying steam to iron.

In a preferred embodiment of the present invention: the blast unit and the steam generating unit arranged separately.

In a preferred embodiment of the present invention: the steam spraying unit can be divided into main spraying unit and blast spraying unit separately, the first outlet connected to the blast spraying unit, the second outlet connected to the main spraying unit.

In a preferred embodiment of the present invention: the blast spraying unit is before the main spraying unit.

In a preferred embodiment of the present invention: both the main spraying unit and blast spraying unit are stainless steel bottom, the stainless steel bottom arranged plural spraying apertures.

In a preferred embodiment of the present invention: the blast unit comprising a blast cavity and a small electric tray for providing heating to the blast cavity, the blast cavity has a first closed space between the first inlet and the first outlet, the small electric tray connect to the first closed space.

In a preferred embodiment of the present invention: the blast unit comprising a blast dripping point and a blast flow passage, the blast flow passage connected to the blast dripping point, and the inlet of the blast dripping point formed the first inlet, the outlet of blast flow passage formed the first outlet.

In a preferred embodiment of the present invention: the blast flow passage is a twist passage.

In a preferred embodiment of the present invention: the main electric tray unit comprising a steam generating cavity and a main electric tray for providing heat to the steam generating cavity, the steam generating cavity has a second closed space between the second inlet and the second outlet, the main electric tray connected to the second closed space.

From above description, the present invention has the following advantages: Because a blast unit arranged for the rapid steaming to blast in a limiting space, it can obviate the disadvantages in the background by designing series structure for improving the blast strength, intensity, to reach high intensity blast with lower cost. The steam spraying unit is stainless steel, it can improve the texture of the iron; the small electric tray and big electric tray mounted separately, thus can use different material or different paint to improve the appearance. The water enter the blast dripping point, then will be steamed rapidly and pushed forwardly till the blast outlet though the blast passage, the carried water will be steamed totally in the twist passage to present water drips.

BRIEF DESCRIPTION OF THE DRAWINGS

The present invention may be more completely understood in consideration of the following detailed description of various embodiments of the present invention in connection with the accompanying drawings, in which.

DETAILED DESCRIPTION OF THE INVENTION

Figure 1:
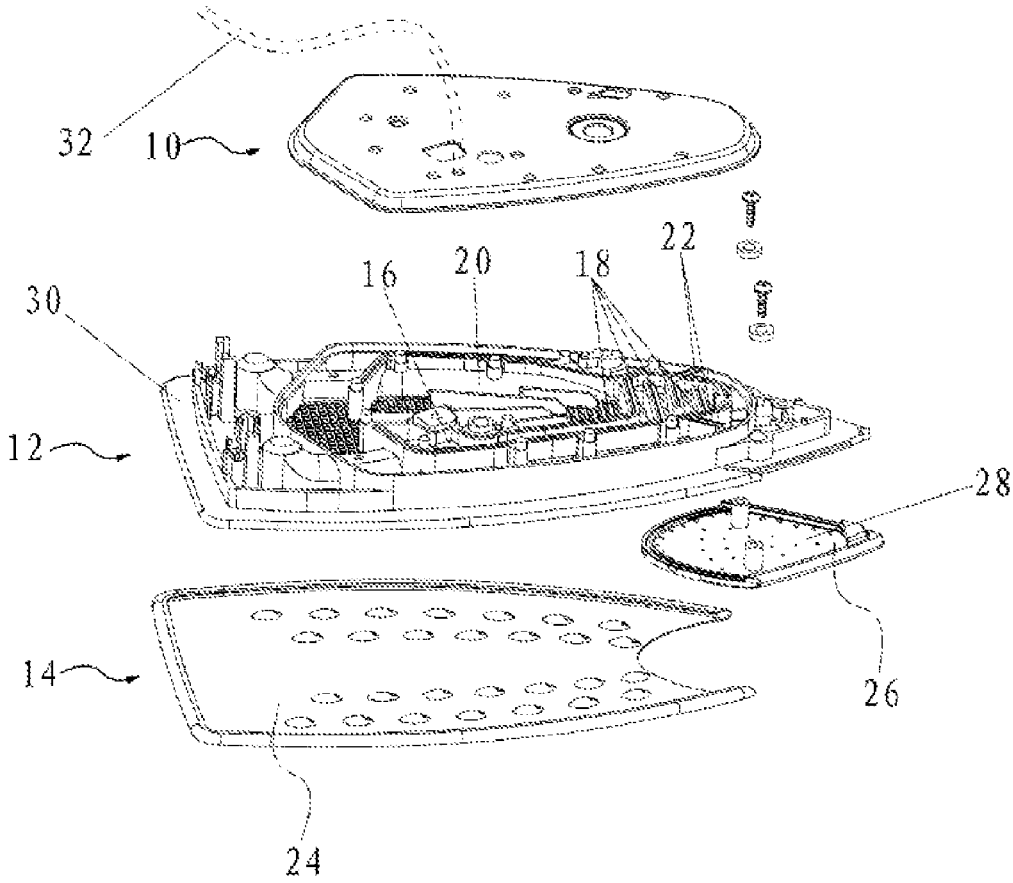
FIG. 1 is an exploded view of the upper shell, lower shell and the steam spraying unit of the iron of the present invention.

Referring to FIG. 1, it is an exploded view of the upper shell, lower shell and the steam spraying unit of the iron of the present invention. An iron comprises a water tank, an upper shell 10, a lower shell 12 and a steam spraying unit 14.

Referring to FIG. 1, the upper shell 10 and the lower shell 12 connected to form a separated blast cavity and a steam generating cavity. The blast cavity has a small electric tray 28 for providing heating for the blast cavity, the blast cavity and the small electric tray 28 cooperated to be the blast unit. The steam generating cavity has a main electric tray 30 for providing heating for the steam generating cavity, the steam generating cavity and the main electric tray 30 cooperated to be the steam generating unit.

Referring to FIG. 1, the blast cavity comprising a blast dripping point 16 and a blast flow passage 18, the blast flow passage 18 is a twist passage. The blast flow passage is connected to the blast dripping point 16, and the inlet of the blast dripping point 16 forms the first inlet, the first inlet connected to the inlet pipe 32 of the water tank, the two outlet of the blast flow passage 18 form two first outlet. The blast dripping point 16 and the blast flow passage 18 cooperated to form a first closed space between the first inlet and the first outlet. The first small electric tray 28 connected to the first closed space, to let the water stream rapidly to blast in a limited space.

Referring to FIG. 1, the steam generating cavity 20 has a second closed space between the second inlet and the second outlet, the second closed space has a steam passage, the second inlet connected to the inlet pipe 32 of the water tank. The main electric tray 30 connected to the second closed space for heating the water to generate steam.

A steam blocking wall 22 set between the said blast flow passage 18 and the steam generating 20 to separate the blast unit and the steam generating unit 20 to form separated and closed unit respectively, because the steam blocking wall, the steam with high blasting intension in the blast cavity can be prevented from flowing into the steam generating cavity 20 and the second outlet, so that to let the steam flow out from the first outlet, and blast in the front portion of the small electric tray 28, even if the small electric tray 28 has small power, it can generate high intension in blasting. Because the high intension of the blast will form a high thrust to the small electric tray 28, it must add a bolt for fixing in the two first outlets respectively, and it must use insert to each other to fix in the front portion. The steam in the steam generating cavity 20 flow into steam flow passage from the second inlet and flow out from the second outlet, the steam from the second outlet flow out from the steam apertures in the stainless steel bottom. Because the steam blocked by the steam blocking wall 22 before it reaches the front portion, it will not flow out the blast flow passage, the steaming and the blasting are separated. Because the steam flowing out from the blast cavity will form pressure to the small electric tray 28, so the small electric tray 28 in the blast cavity must fixed with the bolt.

Referring to FIG. 1, the steam spraying unit 14 can be divided into separated main spraying unit 24 and blast spraying unit 26, the blast spraying unit 26 is before the main spraying unit 24, herein both the main spraying unit 24 and blast spraying unit 26 are stainless steel bottom, the stainless steel bottom arranged plural spraying apertures.

The first outlet of the said blast unit connected to the blast spraying unit 26 to spraying high intension steam for ironing; the second outlet of the said steam generating unit connected to the connected to the main spraying unit 24 to spraying steam for ironing.

The above-mentioned descriptions are of exemplary embodiments only, and are not intended to limit the scope, applicability or configuration of the invention in any way. All changes that come within the meaning and range of equivalency of the claims are to be embraced within their scope.

What is claimed is:

1. An iron, with a water tank, comprising:

a blast unit for rapid steam generation in a limited space to blast steam, having a first inlet and a first outlet, the first inlet connected to an inlet-pipe of an inlet of the water tank;

a steam generating unit for heating water and generating steam, having a second inlet and a second outlet, the second inlet connected to an inlet-pipe of the inlet of the water tank; and a steam spraying unit connected to the first and second outlet, having plural steam apertures;

wherein the steam spraying unit can be divided into a main spraying unit and a blast spraying unit separately, the first outlet is connected to the blast spraying unit, and the second outlet is connected to the main spraying unit; and wherein the blast unit comprises a blast cavity and a small electric tray for providing heating to the blast cavity, the blast cavity has a first closed space between the first inlet and the first outlet, and the small electric tray is connect to the first closed space.

2. The iron according to claim 1, wherein the blast unit and the steam generating unit are arranged separately.

3. The iron according to claim 1, wherein the blast spraying unit is arranged before the main spraying unit.

4. The iron according to claim 3, wherein both the main spraying unit and the blast spraying unit have a stainless steel bottom, on which are arranged a plurality of spraying apertures.

5. The iron according to claim 1, wherein the blast unit comprises a blast dripping point and a blast flow passage connected to the blast dripping point, and wherein the inlet of the blast dripping point forms the first inlet, and the outlet of blast flow passage forms the first outlet.

6. The iron according to claim 5, wherein the blast flow passage is a twist passage.

7. The iron according to claim 1, wherein the main electric tray unit comprises a steam generating cavity and a main electric tray for providing heat to the steam generating cavity, and wherein the steam generating cavity has a second closed space between the second inlet and the second outlet, the main electric tray is connected to the second closed space.

* * * * *